US006062955A

United States Patent [19]

Liu

[11] Patent Number: 6,062,955

[45] Date of Patent: May 16, 2000

[54] INSTALLATION FOR IMPROVING CHEMICAL-MECHANICAL POLISHING OPERATION

[75] Inventor: Ying-Chih Liu, Ping Tung Hsien, Taiwan

[73] Assignee: Worldwide Semiconductor Manufacturing Corp., Hsinchu, Taiwan

[21] Appl. No.: 09/156,522

[22] Filed: Sep. 17, 1998

[30] Foreign Application Priority Data

Aug. 12, 1998 [TW] Taiwan ..... 87113261

[51] Int. Cl.[7] ..... B24B 7/00

[52] U.S. Cl. ..... 451/72; 451/56; 451/443; 451/444; 451/303; 451/296

[58] Field of Search ..... 451/56, 443, 444, 451/303, 296

[56] References Cited

U.S. PATENT DOCUMENTS 3,550,320 12/1970 Kenyon et al. ..... 451/443
5,384,986 1/1995 Hirose et al. ..... 451/444
5,484,323 1/1996 Smith ..... 451/444
5,643,044 7/1997 Lund ..... 451/5
5,643,067 7/1997 Katsuoka et al. ..... 451/56
5,692,947 12/1997 Talieh et al. ..... 451/443

*Primary Examiner*—David A. Scherbel
*Assistant Examiner*—Shantese McDonald
*Attorney, Agent, or Firm*—Hickman Stephens Coleman & Hughes, LLP

[57] ABSTRACT

A chemical-mechanical polishing station having a belt-operated conditioner. The belt-operated conditioner comprises a longitudinal main body, a belt sprinkled with hard particles, and a plurality of rollers. The belt wraps around the external edge of the longitudinal main body and is capable of rotating at a constant speed. The axles of the roller are parallel to each other. Furthermore, all the rollers are positioned within but touching the belt. Consequently, the rollers can rotate when they are driven by the belt. The hard particles sprinkled along the belt are used for scouring the polishing pad so that polishing pad surface can be reconditioned and any residual impurity particles can be removed. The belt-operated conditioner further includes a cleaning device. The cleaning device is used for removing any impurity particles clinging onto the belt when the conditioner is in operation.

19 Claims, 6 Drawing Sheets

INSTALLATION FOR IMPROVING CHEMICAL-MECHANICAL POLISHING OPERATION

CROSS-REFERENCE TO RELATED APPLICATION

This application claims the priority benefit of Taiwan application serial no. 87113261, filed Aug. 12, 1998, the full disclosure of which is incorporated herein by reference.

BACKGROUND OF THE INVENTION

1. Field of Invention

The present invention relates to a chemical-mechanical polishing (CMP) station. More particularly, the present invention relates to a chemical-mechanical polishing station that has a belt-operated pad conditioner for improving the polishing action.

2. Description of Related Art

In the manufacturing of semiconductor devices, surface planarization is an important step in preparing a wafer for a high-resolution photolithographic processing operation. Only a smooth planar surface with little height variation can prevent diffraction of light from a light source when a pattern is transferred. In general, planarization techniques include spin-on-glass (SOG) method and chemical-mechanical polishing method. However, in the sub-half-micron device era, the spin-on-glass method of planarization is incapable of providing the degree of planarity required on a piece of wafer. Consequently, chemical-mechanical polishing has become the only method capable of providing global planarization up to the level of planarity required for fabricating devices in very-large scale integration (VLSI) or even ultra-large scale integration (ULSI) circuits.

FIGS. 1A and 1B are respective top and side views showing a conventional chemical-mechanical polishing station. As shown in FIGS. 1A and 1B, the station includes a polishing table 10, a wafer holder 11 for grasping a wafer 12, a polishing pad 13 over the polishing table 10, a tube 14 for carrying slurry 15 to the polishing pad 13, a liquid pump 16 for pumping slurry 15 into the tube 14, and a conditioner 17 for dressing the surface of the polishing pad 13. When the chemical-mechanical polishing station is carrying out a polishing action, the polishing table 10 and the wafer holder 11 independently spin in a pre-defined, opposite direction, for example, directions 18*a* and 18*b* respectively. The wafer holder 11, while gripping the backside 19 of the wafer 12, presses the front side 20 of the wafer 12 against the polishing pad 13. The liquid pump also works to continuously pump slurry 15 to the polishing pad 13 through the tube 14. The polishing action in a chemical-mechanical polishing operation relies on chemical reagents and abrasive particles suspended in the slurry. The reagents react chemically with molecules on the front surface 20 of the wafer 12 to form an easy-grind layer, while the abrasive particles of the slurry 15 help to remove pointed peaks within the easy-grind layer. By continuous chemical reaction and repeated mechanical abrasion, a highly polished and planar surface is ultimately formed on the wafer surface.

One major drawback of the aforementioned chemical-mechanical polishing station is that the conventional conditioner 17 is incapable of re-conditioning the surface of the polishing pad 13 to the original high degree of planarity and uniformity. FIG. 2A shows a top view and a side view of the first type of conventional chemical-mechanical mechanical polishing station. The particular station as shown in FIG. 2A has a model number IPEC-472. The station IPEC-472 has a polishing pad 30 located above the polishing table 32. Above the polishing pad 30, a wafer 34 and a conditioner 36 are placed.

When the wafer 34 is being polished, the conditioner 36 will move forward and backward following the directions as indicated by the arrow 38 so that the polishing pad 30 can be re-conditioned back into a planar surface. FIG. 2B shows a top view and a side view of the second type of conventional chemical-mechanical polishing station. The particular station as shown in FIG. 2B has a model number AMAT-Mirra. The station AMAT-Mirra has a polishing pad 40 located above the polishing table 42. A wafer 44 and a conditioner 46 are placed above the polishing pad 40.

When the wafer 44 is being polished, the conditioner 46 swings to the left and right according to the directions indicated by the arrow 48 so that the polishing pad 40 can be re-conditioned into a planar surface. FIG. 2C is a diagram showing a portion of the tracks left by the respective conditioners when the polishing pads of the polishing stations as shown in FIGS. 2A and 2B are re-conditioned. As seen in FIG. 2C, the tracks produced by the conditioner are not uniform. For example, some places are rarely touched by the conditioner, thereby leading to under-conditioning of the polishing pad as indicated by the relatively blank region in area 54. On the other hand, some areas have been repeatedly scoured causing over-conditioning of the polishing pad. An example is the area 56 near the crossing point between two trajectories. Consequently, only a few places such as track area 52 are normally conditioned.

FIG. 3A shown a top view and a side view of the third type of conventional chemical-mechanical polishing station. The particular station as shown in FIG. 3A has a model number SpeedFam Auriga. The station SpeedFam Auriga has a polishing pad 60 located above a polishing table 62. Above the polishing pad 60, a wafer 64 and a conditioner 66 are placed. The conditioner 66 has a diamond ring structure, for example.

When the wafer 64 is being polished, the conditioner 66 sweeps over the peripheral regions of the polishing table 62 to recondition the polishing pad 60 into a flatter surface. FIG. 3B is a cross-section showing the resulting profile of the polishing pad after the polishing pad is conditioned by the conditioner as shown in FIG. 3A. In FIG. 3B, units of the horizontal axis are marked in centimeters (cm). It is obvious from FIG. 3B that after the conditioner has been used for a while because the pad profile of the polishing pad 60 is highly irregular and non-uniform. In fact, the polishing pad 60 has a central bulge region and a sagging edge region. Consequently, the polishing surface of the polishing pad for polishing the silicon wafer 64 becomes highly irregular. Hence, wafer 64 near the central region is polished more while the peripheral region is polished less.

FIG. 4A shows a top view and a side view of the fourth type of conventional chemical-mechanical polishing station. The particular station as shown in FIG. 4A has a model number Cybeq-IP8000. The station Cybeq-IP8000 has a polishing pad 70 located above a polishing table 72. A wafer 74 and a conditioner 76 are placed above the polishing pad 70. When the wafer 74 is being polished, the condiitoner 76 will sweep over the peripheral regions of the polishing table 72 to recondition the polishing pad 70 into a flatter surface.

FIG. 4B is a cross-section showing the resulting profile of the polishing pad after the polishing pad is conditioned by the conditioner as shown in FIG. 4A. It is obvious from FIG. 4B that after the conditioner has been used for a while pad profile 78 of the polishing pad 70 becomes highly irregular and non-uniform. Consequently, the polishing surface for polishing the silicon wafer 74 becomes uneven. Hence, wafer 64 near the central region is polished less while the peripheral region is polished more (just opposite to the situation in FIG. 3B).

In summary, all four conditioners 36, 46, 66 and 76 employed by various models of polishing stations cause non-uniformity of the polishing pad due to uneven distribution of scouring tracks (as indicated by FIG. 2C). Therefore, after the polishing pad has been reconditioned by one of the conditioners for awhile, problematic height difference can be found all across the pad surface (as shown in FIGS. 3B and 4B). Hence, ultimate wafer profile produced by the polishing station can be highly irregular, thus severely compromising the quality of wafer finish.

In light of the foregoing, there is a need to provide an improved conditioner for conditioning the polishing pad in a chemical-mechanical polishing station.

SUMMARY OF THE INVENTION

Accordingly, the present invention provides a chemical-mechanical polishing station having a special belt-operated conditioner. The conditioner has a diamond-sprinkled belt and a plurality of axially parallel rollers. The diamond belt is capable of rotating at a fixed rate and thus driving the rollers. Hence, the scouring trajectories of the conditioner are evenly distributed. Moreover, the conditioned polishing pad remains relatively flat even when the conditioner has been used to condition the pad for some time.

In another aspect, this invention provides a chemical-mechanical polishing station having a special belt-operated conditioner that further includes a cleaning device for cleaning the conditioner while the polishing pad is being conditioned. Therefore, any residual impurity particles on the belt can be removed, and quality of the particular polishing station can be improved.

To achieve these and other advantages and in accordance with the purpose of the invention, as embodied and broadly described herein, the invention provides a chemical-mechanical polishing station. The station includes: a polishing table having a pre-defined direction of rotation; a polishing pad above the polishing table; a wafer holder for grasping the backside of a wafer and then pressing the front surface of the wafer onto the polishing pad; a belt-operated conditioner positioned above the polishing pad for scouring the polishing pad, and thus planarizing and removing residual impurity particles from its surface; and a tube positioned above the polishing pad for conveying slurry to the polishing pad. A liquid pump, which is connected to the handle of the tube for delivering slurry, is also included.

The belt-operated conditioner has a linear structure that includes: a longitudinal main body; a belt such as a leather belt that wraps around the outer edge of the longitudinal main body and is capable of rotating at a fixed rate: a plurality of rollers whose axes are parallel to each other, such that all the rollers are positioned interior to but touching the belt, by which the rollers are consequently able to rotate when driven by the belt; a driving motor installed on the longitudinal main body for moving the belt; and a number of hard particles such as diamond particles sprinkled along the belt for scouring the polishing pad so that a planar surface is obtained and residual impurity particles are removed. The belt-operated conditioner further includes a cleaning device. The cleaning device is installed at one end of the conditioner such that it is mounted in a position away from the polishing pad. The cleaning device is used for washing away any impurity particles clinging onto the belt when the conditioner is in operation. The cleaning device comprises a brush and a water sprayer. The brush is in contact with the belt surface, whereas the water sprayer produces a cleaning jet aiming at the contact surface between the brush and the belt.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
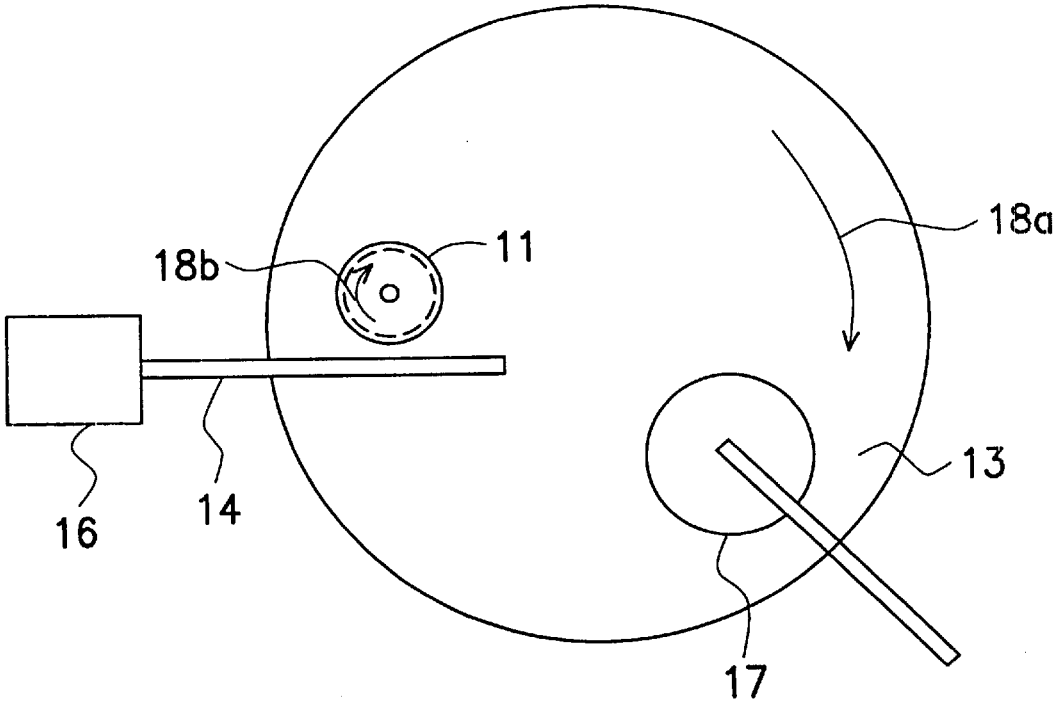
FIG. 1A (PRIOR ART)
FIG. 1A is a top view showing a conventional chemical-mechanical polishing station.

Reference will now be made in detail to the present preferred embodiments of the invention, examples of which are illustrated in the accompanying drawings. Wherever possible, the same reference numbers are used in the drawings and the description to refer to the same or like parts.

One major aspect of this invention is the introduction of a new type of conditioner to replace the conventional one. The new conditioner has a linear structure that has diamond-sprinkled belt and a number of axially parallel rollers. The diamond belt can rotate at a fixed rate so that the rollers can also be driven into rotation. Consequently, the grinding force contributed by each moving part of the conditioner is equally spread, and the polishing pad is evenly traversed. In addition, a cleaning device is also mounted onto the conditioner so that in-situ cleaning of the conditioner can be provided. In fact, the cleaning device is capable of removing any residual impurity particles on the belt while the conditioner is scouring the polishing pad, thus raising the quality of surface finish.

Figure 1B:
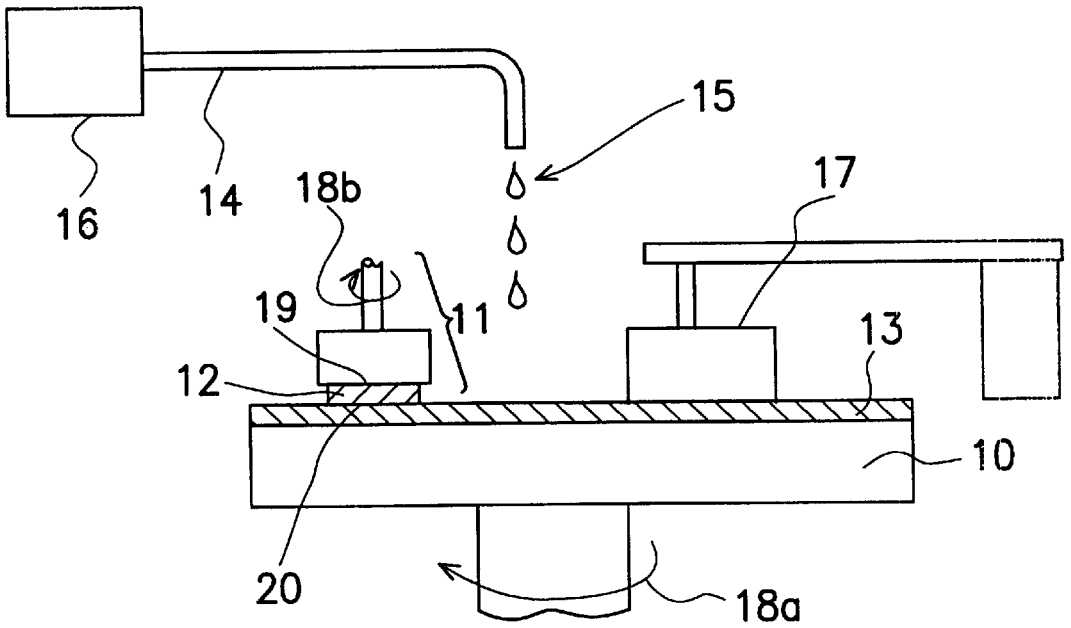
FIG. 1B (PRIOR ART)
FIG. 1B is a side view showing a conventional chemical-mechanical polishing station.
Figure 2A:
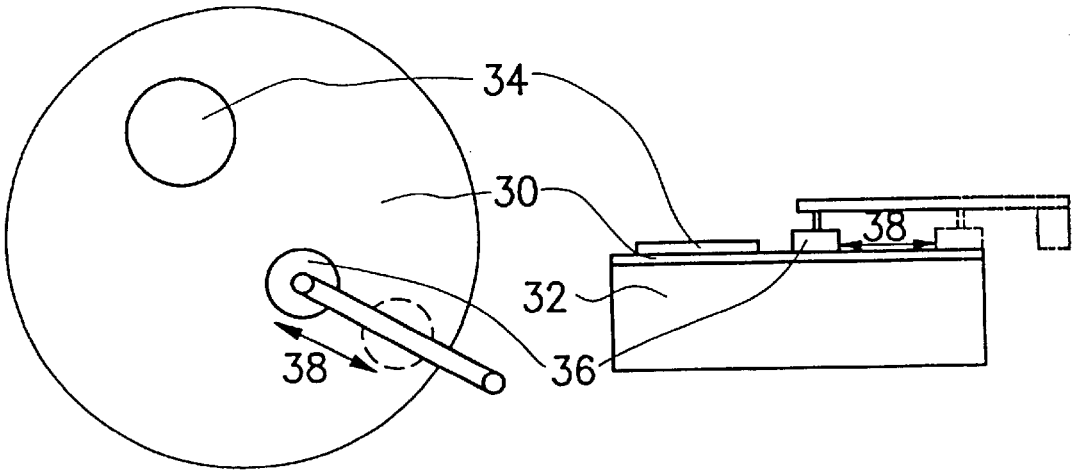
FIG. 2A (PRIOR ART)
FIG. 2A shows a top view and a side view of the first type of conventional chemical-mechanical polishing station.
Figure 2B:
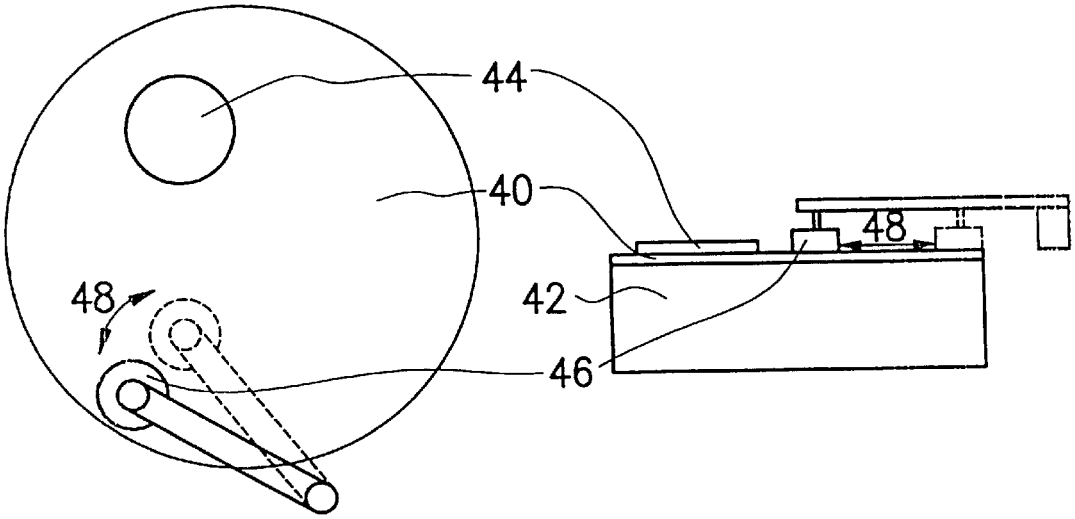
FIG. 2B (PRIOR ART)
FIG. 2B shows a top view and a side view of the second type of conventional chemical-mechanical polishing station.
Figure 2C:
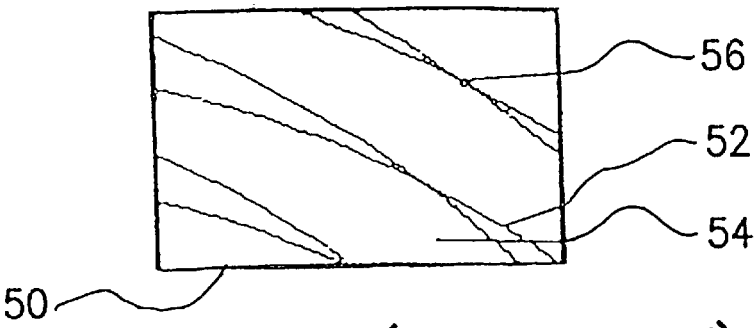
FIG. 2C (PRIOR ART)
FIG. 2C is a diagram showing a portion of the tracks followed by the respective conditioners when the polishing pads of the polishing stations as shown in FIGS. 2A and 2B are re-conditioned.
Figure 3A:
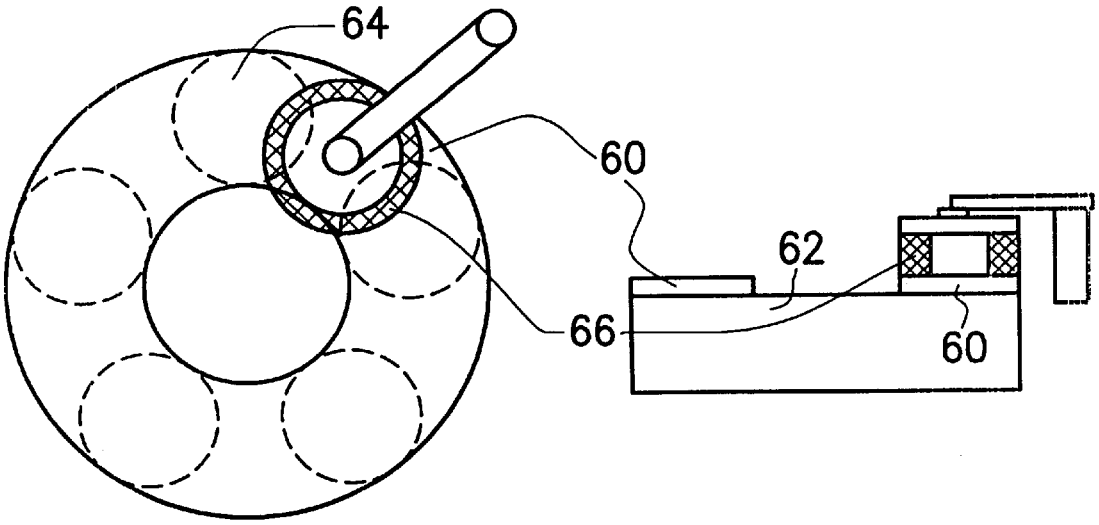
FIG. 3A (PRIOR ART)
FIG. 3A shows a top view and a side view of the third type of conventional chemical-mechanical polishing station.
Figure 3B:
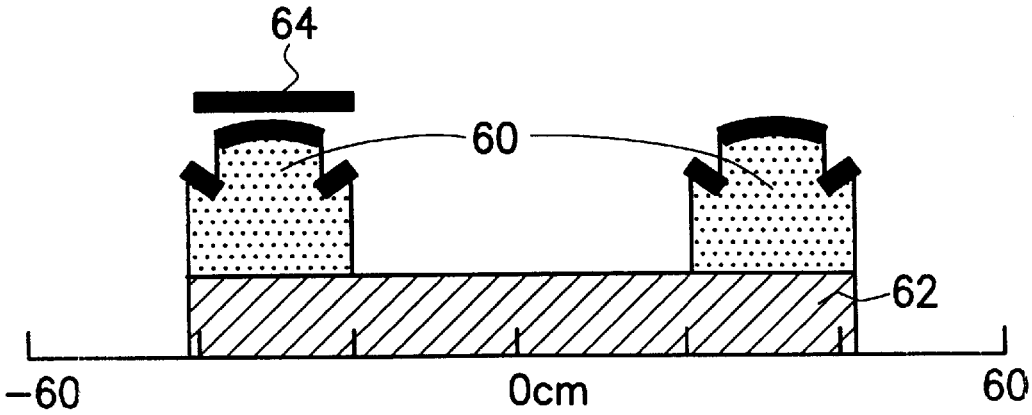
FIG. 3B (PRIOR ART)
FIG. 3B is a cross-section showing the resulting profile of the polishing pad after the polishing pad is conditioned by the conditioner as shown in FIG. 3A.
Figure 4A:
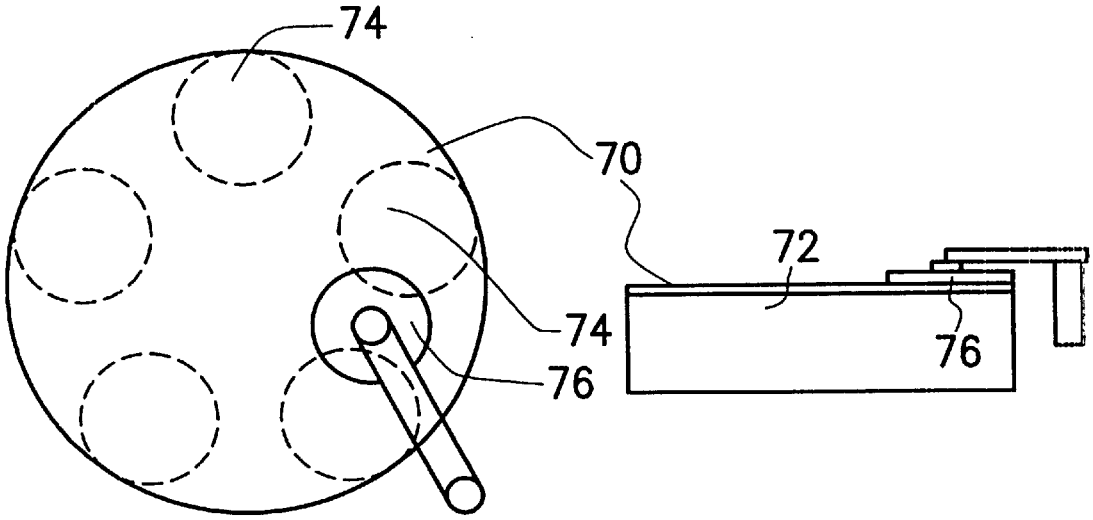
FIG. 4A (PRIOR ART)
FIG. 4A shows a top view and a side view of the fourth type of conventional chemical-mechanical polishing station.
Figure 4B:
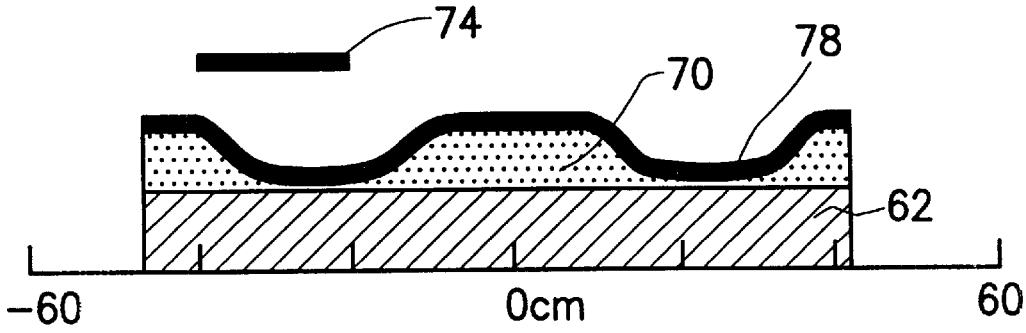
FIG. 4B (PRIOR ART)
FIG. 4B is a cross-section showing the resulting profile of the polishing pad after the polishing pad is conditioned by the conditioner as shown in FIG. 4A.
Figure 5A:
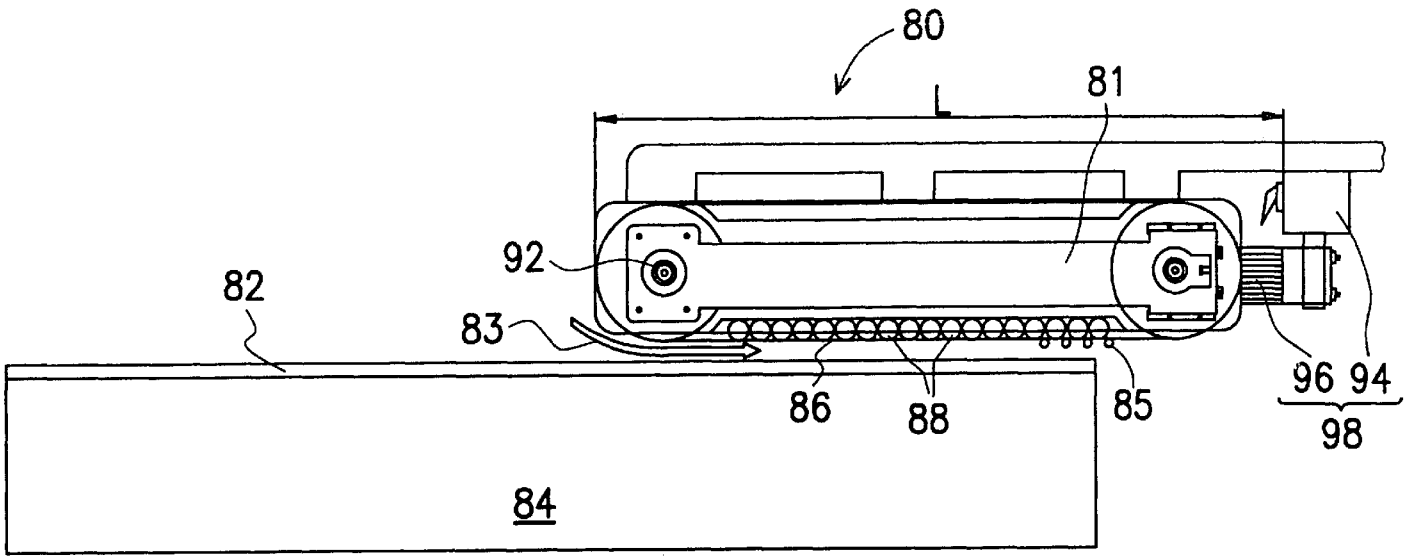
FIG. 5A is a side view showing the conditioner of a chemical-mechanical polishing station according to one preferred embodiment of this invention.
Figure 5B:
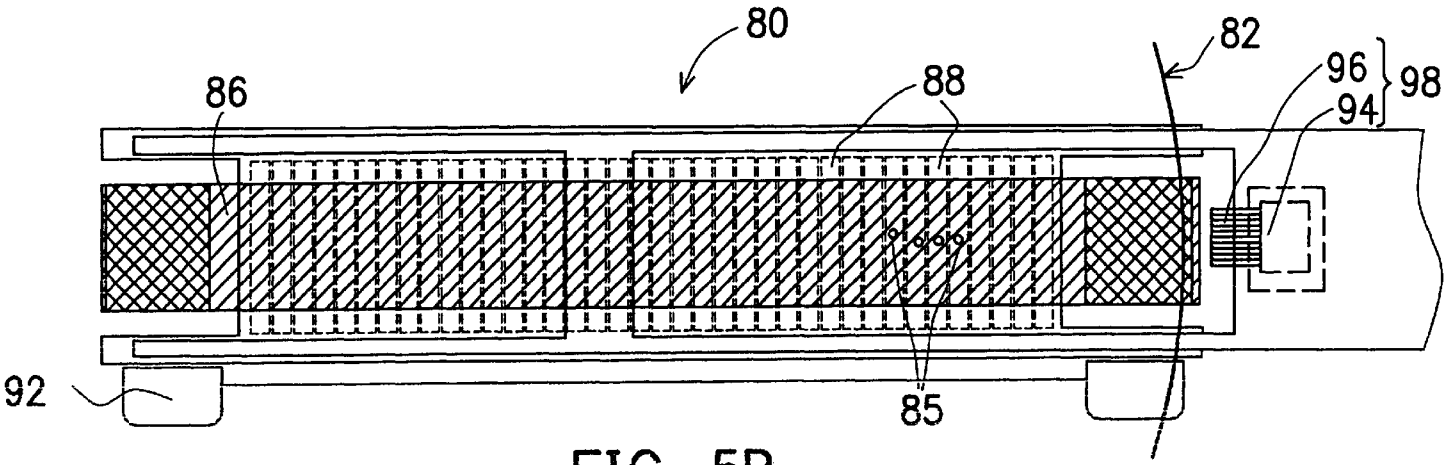
FIG. 5B is a top view showing the conditioner of a chemical-mechanical polishing station according to one preferred embodiment of this invention.

FIGS. 5A and 5B are a side view and a top view showing the conditioner of a chemical-mechanical polishing station according to one preferred embodiment of this invention. As shown in FIGS. 5A and 5B, the chemical-mechanical polishing station of this invention has some elements that are similar to the elements in FIG. 1A. Hence, identical labels are used in both figures. The polishing station in this invention includes: a polishing table 84; a wafer holder 11 (as shown in FIGS. 1A and 1B) for grasping a wafer 12 (as shown in FIG. 1B); a polishing pad 82 above the polishing table 84; a tube 14 (as shown in FIGS. 1A and 1B) positioned above the polishing pad 82 for conveying slurry 15 to the polishing pad 82; and a liquid pump for pumping slurry 15 to the polishing pad 82 by way of the tube 14 (as shown in FIGS. 1A and 1B).

One major aspect of this invention is the design of the conditioner 80. Unlike a conventional conditioner, the conditioner of this invention is capable of producing a uniform and flat polishing pad 82 surface. As shown in FIGS. 5A and 5B, the conditioner has a linear structure. The linear structure of the conditioner 80 includes a longitudinal main body 81. The longitudinal main body 81 is a trunk for joining with other subsidiary elements. Preferably, length of the main body 81 is longer than the diameter of a silicon wafer.

Around the external edge of the longitudinal main body 81, a belt 86, for example, a leather belt, is wrapped so that the belt 86 can rotate at a constant speed in a direction indicated by arrow 83. On the externally facing side of the belt 86, a number of hard particles 85 such as diamond dust are evenly sprinkled. The diamond dust on the belt 86 is used as contact edges for scouring the polishing pad 82 surface so that a planar surface is obtained and any residual impurity particles on the polishing pad 82 are removed. The conditioner 80 further includes a number of rollers 88 with their axles all running parallel to each other. The roller 88 are mounted on the interior side of the belt 86, but all of them touch the belt 86.

Hence, when the belt 86 is driven, all the rollers will rotate, as well. Furthermore, the conditioner 80 includes a driving motor 92 for driving the belt 86. The driving motor 92 is fixed inside the longitudinal main body 81 under the belt. For example, the driving motor 92 can be mounted on either end of the longitudinal main body 81.

Besides having a main body 81 and associated elements, the conditioner 80 can further include a cleaning device 98. The cleaning device 98 can be mounted onto one end of the belt-operated conditioner 80 far away from the polishing pad 82. Consequently, pad conditioning can be conducted in tandem with a cleaning operation so that any residual impurity particles on the belt 86 can be immediately washed away. The cleaning device 98 comprises a brush 96 and a water sprayer 94.

In operation, the brush 96 is in direct contact with the belt 86 surface, while the water sprayer 94 sends out a jet of water aiming at the place of contact between the brush 96 and the belt 86. Hence, any impurity particles deposited on the belt 86 can be scrubbed and washed away. Therefore, the cleaning device 98 mainly serves to clear the belt 86 of any impurity particles when the conditioner 80 is performing a re-conditioning operation so that a higher quality surface finish can be obtained.

Figure 6:
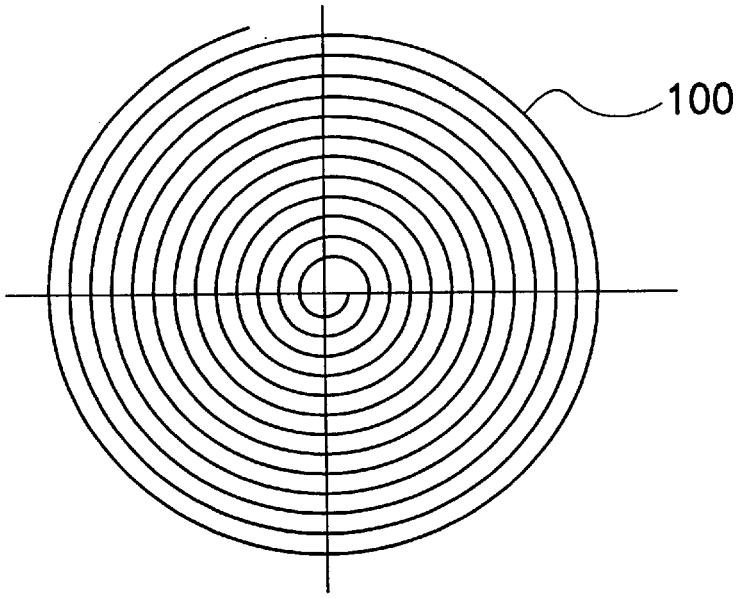
FIG. 6 is a diagram showing the tracks followed by the conditioner of this invention when the polishing pads of the polishing stations are re-conditioned.

FIG. 6 is a diagram showing the tracks followed by the conditioner of this invention when the polishing pads of the polishing stations are re-conditioned. In FIG. 6, spiraling line 100 represents the path taken by the conditioner when the conditioner is scouring the polishing pad during a reconditioning operation. Unlike the many crossings and sometimes crowded paths taken by a conventional conditioner, the conditioner of this invention move evenly and smoothly across the polishing pad. Hence, under-conditioning or over-conditioning rarely occurs, and a higher level of planarity and uniformity for a reconditioned surface can be obtained. Moreover, the conditioner 80 is also equipped with a cleaning device 98. Therefore, whenever the conditioner 80 is performing a reconditioning operation, any impurity material deposited on the belt surface can be removed.

Figure 7:
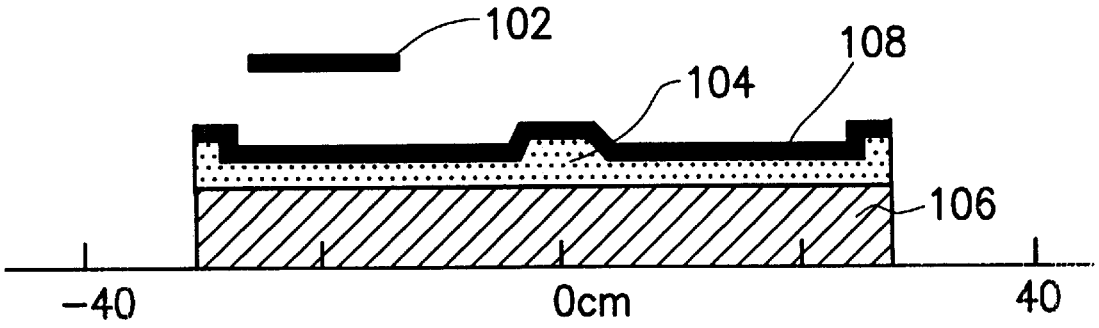
FIG. 7 is a cross-section showing the resulting profile of the polishing pad after the polishing pad is conditioned by the conditioner as shown in FIGS. 5A and 5B.

FIG. 7 is a cross-section showing the resulting profile of the polishing pad after the polishing pad is conditioned by the conditioner as shown in FIGS. 5A and 5B. In FIG. 7, the horizontal axis is a measure of the width of a polishing table 106 in centimeters (cm). The polishing pad 104 is placed on top of the polishing table 106, and a silicon wafer 102 is positioned above the polishing pad 104. After the conditioner has been operating for a while, the degree of wear on the polishing pad 104 can be easily observed. The surface 108 of the polishing pad 104 is lightly concave forming a recess cavity. However, with this invention, a certain degree of planarity and uniformity can still be maintained at the bottom of the recess cavity.

In summary, major aspects of this chemical-mechanical polishing station include:

1. The conditioner 80 has a diamond-sprinkled belt 86 and parallel roller 88 both working together to recondition the polishing pad surface. The conditioner 80 follows a smooth and evenly spaced track while the polishing pad is being serviced.

2. Although wearing of the polishing pad 82 is still inevitable after some reconditioning operation by the conditioner 80, the cross-sectional profile of the polishing pad 82 is still relatively planar and uniform. Consequently, wafer polishing is little affected, and quality of finish can be maintained.

3. The conditioner 80 of this invention can further include a cleaning device 98 with a brush 96 and a water sprayer 94. Therefore, any residual impurity particles deposited on the belt while undergoing a reconditioning operation can be carried away, thus further improve the quality of surface finish.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chemical-mechanical polishing station, comprising:

a polishing table having a pre-defined direction of rotation;

a polishing pad above the polishing table;

a holder for grasping the backside of a wafer and then pressing the front surface of the wafer onto the polishing pad;

a belt-operated conditioner positioned above the polishing pad for conditioning the polishing pad back into a planar surface and for removing any residual impurities above the polishing pad;

a tube positioned above the polishing pad for delivering slurry onto the polishing pad; and a cleaning device fixed to one end of the belt-operated conditioner away from the polishing pad for removing any impurity particles deposited on the belt during operation.

2. The cleaning device of claim 1, wherein the cleaning device further includes a brush such that the brush is in contact with the belt-operated conditioner during the reconditioning operation.

3. The cleaning device of claim 1, wherein the cleaning device further includes a water sprayer for spraying necessary cleaning liquid on the contact surface between the brush and the belt-operated conditioner.

4. The station of claim 1, wherein the station further includes a liquid pump connected to the handle of the tube so that slurry can be pumped to the polishing pad via the tube.

5. The station of claim 1, wherein the belt-operated conditioner has a linear structure.

6. The station of claim 1, wherein the belt-operated conditioner has a linear dimension greater than the diameter of the silicon wafer.

7. A chemical-mechanical polishing station, comprising:

a polishing table having a pre-defined direction of rotation;

a polishing pad above the polishing table;

a holder for grasping the backside of a wafer and then pressing the front surface of the wafer onto the polishing pad;

a belt-operated conditioner positioned above the polishing pad for conditioning the polishing pad back into a planar surface and for removing any residual impurities above the polishing pad;

a tube positioned above the polishing pad for delivering slurry onto the polishing pad;

wherein the belt-operated conditioner further includes:

a longitudinal main body;

a belt wrapping the external edge of the longitudinal main body and capable of rotating at a constant speed;

a plurality of rollers whose axles are parallel to each other, wherein the rollers are positioned within but touching the belt, and hence the rollers can be driven by the belt into rotary motion; and a plurality of hard particles distrusted evenly on the externally faced belt surface for grinding the polishing pad surface and for removing any residual impurity particles from the polishing pad.

8. The conditioner of claim 7, wherein the belt includes a leather belt.

9. The conditioner of claim 7, wherein the hard particles include diamond dust particles.

10. The conditioner of claim 7, wherein the conditioner further includes a driving motor fixed inside the longitudinal main body for rotating the belt.

11. A conditioner for operating a chemical-mechanical polishing station, wherein the chemical-mechanical polishing station includes a polishing table, a polishing pad and a tube, the polishing table is capable of rotating in a pre-defined direction, the polishing pad is positioned above the polishing table, and the tube is positioned above the polishing pad for delivering slurry to the pad, the conditioner comprising:

a longitudinal main body;

a belt wrapping the external edge of the longitudinal main body and capable of rotating at a constant speed;

a plurality of roller whose axles are parallel to each other, wherein the rollers are positioned under but touching the belt, and hence the rollers can be driven by the belt into rotary motion; and a plurality of hard particles distributed evenly on the exposed belt surface for grinding the polishing pad surface and for removing any residual impurity particles from the polishing pad.

12. The conditioner of claim 11, wherein the station further includes a cleaning device fixed to one end of the longitudinal main body away from the polishing pad for removing any impurity particles deposited on the belt during the reconditioning operation.

13. The cleaning device of claim 12, wherein the cleaning device further includes a brush such that the brush is in contact with the belt-operated conditioner during operation.

14. The cleaning device of claim 12, wherein the cleaning device further includes a water sprayer for spraying necessary cleaning liquid at the contact surface between the brush and the belt-operated conditioner.

15. The conditioner of claim 11, wherein the longitudinal main body has a linear structure.

16. The conditioner of claim 11, wherein the longitudinal main body has a linear dimension greater than the diameter of the silicon wafer.

17. The conditioner of claim 11, wherein the belt includes a leather belt.

18. The conditioner of claim 11, wherein the hard particles include diamond dust particles.

19. The conditioner of claim 11, wherein the conditioner further includes a driving motor fixed inside the longitudinal main body for rotating the belt.

* * * * *